US006005212A

United States Patent [19]

Van Lierde et al.

[11] Patent Number: 6,005,212

[45] Date of Patent: Dec. 21, 1999

[54] FEED DEVICE FOR FEEDING MAIL ITEMS OF VARIOUS DIMENSIONS

[75] Inventors: Olivier Van Lierde, Bourg la Reine; Alain Philippe, Saint Pathus, both of France

[73] Assignee: Neopost Industrie, Bagneux, France

[21] Appl. No.: 09/015,528

[22] Filed: Jan. 29, 1998

[30] Foreign Application Priority Data

Jan. 31, 1997 [FR] France ..... 97 01053

[51] Int. Cl.[6] ..... B07C 5/04; B65H 5/22

[52] U.S. Cl. ..... 209/586; 271/3.15; 271/265.02; 209/900; 209/910

[58] Field of Search ..... 271/3.15, 3.16, 271/265.02; 209/900, 910, 584, 586, 587, 659

[56] References Cited

U.S. PATENT DOCUMENTS

| | | | |
|---|---|---|---|
| 4,030,722 | 6/1977 | Irvine et al. . | |
| 4,082,263 | 4/1978 | Baumberger et al. | 271/265.02 |
| 4,432,458 | 2/1984 | Daboub | 209/900 |
| 5,101,981 | 4/1992 | Carbone et al. | 209/900 |
| 5,156,278 | 10/1992 | Aaron et al. | 209/586 |
| 5,236,072 | 8/1993 | Cargill | 209/586 |

FOREIGN PATENT DOCUMENTS

| | | | |
|---|---|---|---|
| 002049407 | 2/1992 | Canada | 209/900 |
| 0 376 481 A3 | 7/1990 | European Pat. Off. . | |
| 0 581 392 A2 | 2/1994 | European Pat. Off. . | |

*Primary Examiner*—Donald P. Walsh
*Assistant Examiner*—Daniel K Schlak
*Attorney, Agent, or Firm*—Sughrue, Mion, Zinn, Macpeak & Seas, PLLC

[57] ABSTRACT

A mail item feed device having a first or mail item feed area, a second or selector area and a third or conveyor area and including a first plurality of sensors for identifying the various formats of the mail items present in said first area, a second plurality of sensors for detecting the passage of the mail items in said second and third areas, and a plurality of drive means for co-operating with the transport rollers of the first, second and third areas and actuated selectively in a predetermined sequence defined by control means in accordance with the state of each of the first and second plurality of sensors.

9 Claims, 4 Drawing Sheets

FEED DEVICE FOR FEEDING MAIL ITEMS OF VARIOUS DIMENSIONS

FIELD OF THE INVENTION

The present invention relates exclusively to the field of mail processing, and is more particularly concerned with a device for feeding a postage meter (or "franking machine") with mail items of various dimensional characteristics, and especially items of various lengths.

PRIOR ART

Conventionally, a franking machine must be adapted to receive mail items of various types, such as documents, letters, or envelopes of various dimensions. To this end it often includes on the upstream side of a slot for inserting such items, a feed device for conveying envelopes with the flap folded down or folded open, and for doing so at various speeds. That automatic feed device, or feeder, usually includes means for receiving/stacking, selecting, transporting and possibly closing mail items that must afterwards be processed by the franking machine.

Patent EP 581 392 describes a feed device of the above kind for stacked items, including a hopper part and transport means. Said transport means feed the articles both towards the front, and laterally using inclined rollers. Said transport means co-operate with said hopper part to cause the fed items to be arranged like the scales of a fish.

The use of a rear jogger system in the hopper part complicates the loading of the feeder with mail items. It also requires the presence in the hopper part of mail item transport means associated with means for referencing and stacking said mail items beforehand.

OBJECT AND DEFINITION OF THE INVENTION

The essential aim of the present invention is to overcome the above drawback by proposing a particularly reliable mail item feed device adapted to be disposed on the upstream side of a franking machine to facilitate the feeding thereof with mail items of various sizes and not requiring any rear jogger means. Another aim of the invention is to enable active control of the routing of mail items in the feeder for optimum control of the drive means by which said items are transported.

The above aims are achieved by a device for feeding mail items adapted to be mounted on the upstream side of a franking machine and including in succession along a transport path of said mail items a first or mail item feed area for receiving a stack of mail items of various formats and including a first plurality of transport rollers, a second or selector area for individually selecting said mail items and including a second plurality of transport rollers, and a third or conveyor area for conveying the items extracted individually from the stack of mail items one by one and directing them to the franking machine and including a third plurality of transport rollers, the device including a first plurality of sensors for identifying the various formats of the mail items present in said first area, a second plurality of sensors for detecting passage of the mail items through said second and third areas, and a plurality of drive means adapted to co-operate with said pluralities of transport rollers and actuated selectively in a predetermined sequence defined by control means according to the state of each of said first and second pluralities of sensors.

This specific structure enables the feed device of the invention to process mail items of various dimensions in a particularly reliable manner. Starting/stopping each of the feed means co-operating with the various transport rollers in accordance with the states of the various sensors optimizes the use of the drive means and consequently significantly increases their service life and that of the feed device as a whole. Furthermore, the invention takes into account the format of the mail items and this influences the operating cycle time, which is of prime importance given that the postal imprint must be applied at a standardized distance from the edge of said mail items.

In accordance with the invention the first plurality of sensors determines a predetermined mail item format. The first plurality of sensors preferably includes a first format sensor C5 at the entry of the feed area for determining large format mail items, a second format sensor C3 at the exit of the feed area for determining small format mail items, and a third format sensor C4 in a middle area of the feed area for determining medium format mail items.

In a preferred embodiment, each of the sensors of the first plurality of sensors C5, C4, C3 for determining mail formats is a reflective type sensor.

In accordance with the invention, each of the sensors of the second plurality of sensors determines the passage of a mail item at a predetermined location. The second plurality of sensors preferably includes a first or selector sensor C2 at the exit of the selector area, and a second or conveyor sensor C1 disposed further downstream in the conveyor area.

In a preferred embodiment, each of the sensors of the second plurality of sensors is an opto-mechanical type sensor actuated by the passage of the edge of a mail item.

The plurality of drive means advantageously includes a first clutch E1 in the selector area and driving transport rollers of the selector area and second and third clutches E2, E3 in the feed area and driving transport rollers of the feed area. The second and third clutches respectively and independently drive separate first and second sets of transport rollers of the feed area.

The clutches are preferably driven via a set of cogs and belts from a single drive motor which also drives the transport rollers of the conveyor area.

BRIEF DESCRIPTION OF THE DRAWINGS

Other features and advantages of the present invention will become more apparent from the following description given by way of non-limiting example with reference to the appended drawings, in which.

DETAILED DESCRIPTION OF A PREFERRED EMBODIMENT OF THE INVENTION

Figure 1:
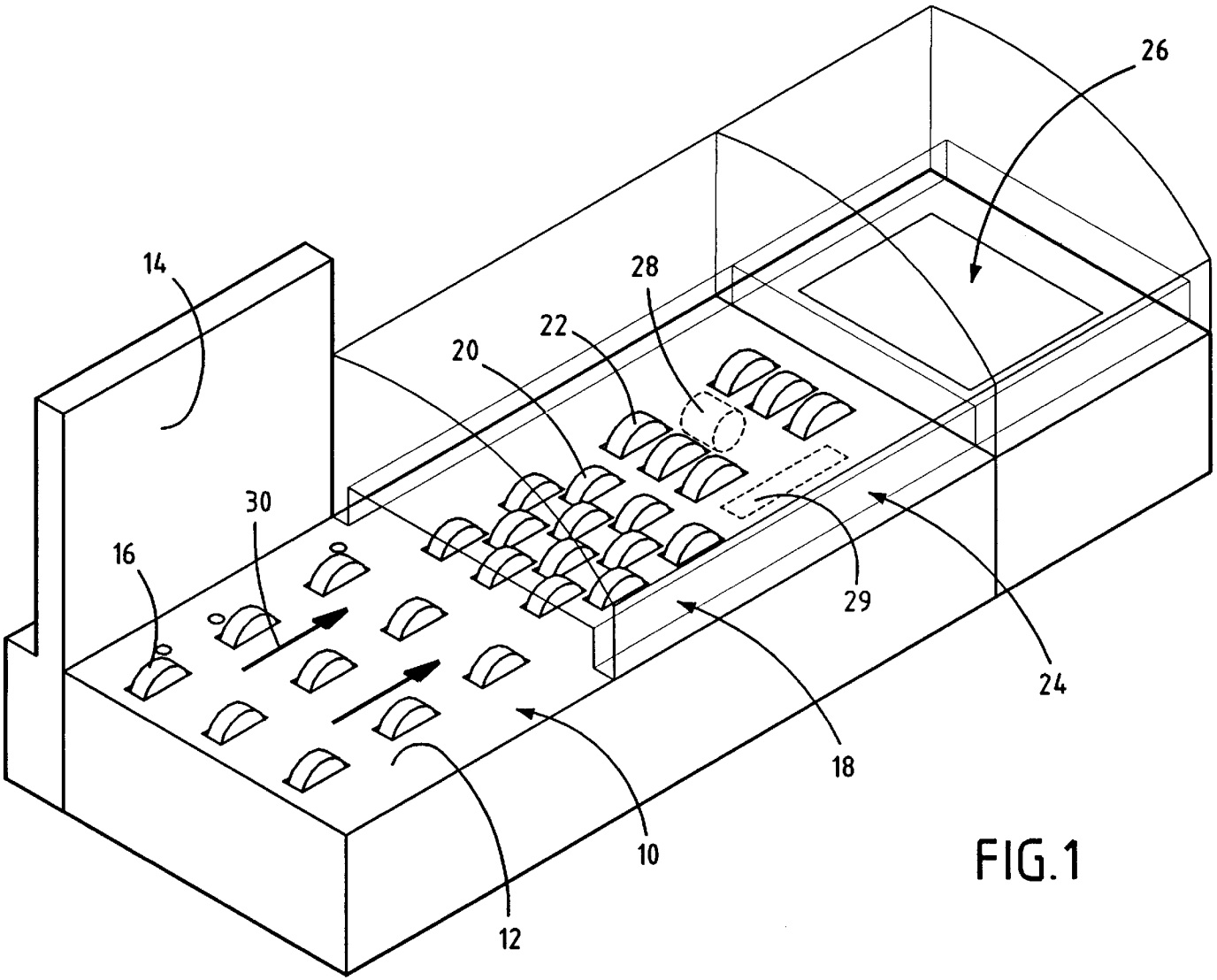
FIG. 1 is a diagrammatic perspective view of a mail item feed device of the invention.

The mail item feed device from FIG. 1 includes a feed area 10 essentially formed of a plate 12 and a mobile lateral wall 14 and adapted to receive a stack of mail items with various dimensions having flaps that are folded down or not. This area includes first transport means including a plurality of rollers 16 for moving the mail items in the downstream direction in a separator and transport area 18 including selector means including a presser and a throat (not shown)

and a plurality of rollers 20 and from which said items are extracted individually from the stack. Finally, second transport means including a plurality of rollers 22 are provided in a conveyor area 24 at the exit of said separator area to transfer further downstream the mail items extracted in this way one by one, for example, to a mail item closing area 26, if the feed device has one. The feed device further includes various control and monitoring means known in themselves (not shown except for a main drive motor 28 and a microprocessor-based control unit 29) necessary for it to operate (in particular for it to actuate the various rollers during the routing of mail items along a transport path 30) and which there is therefore no need to describe in more detail.

Figure 2:
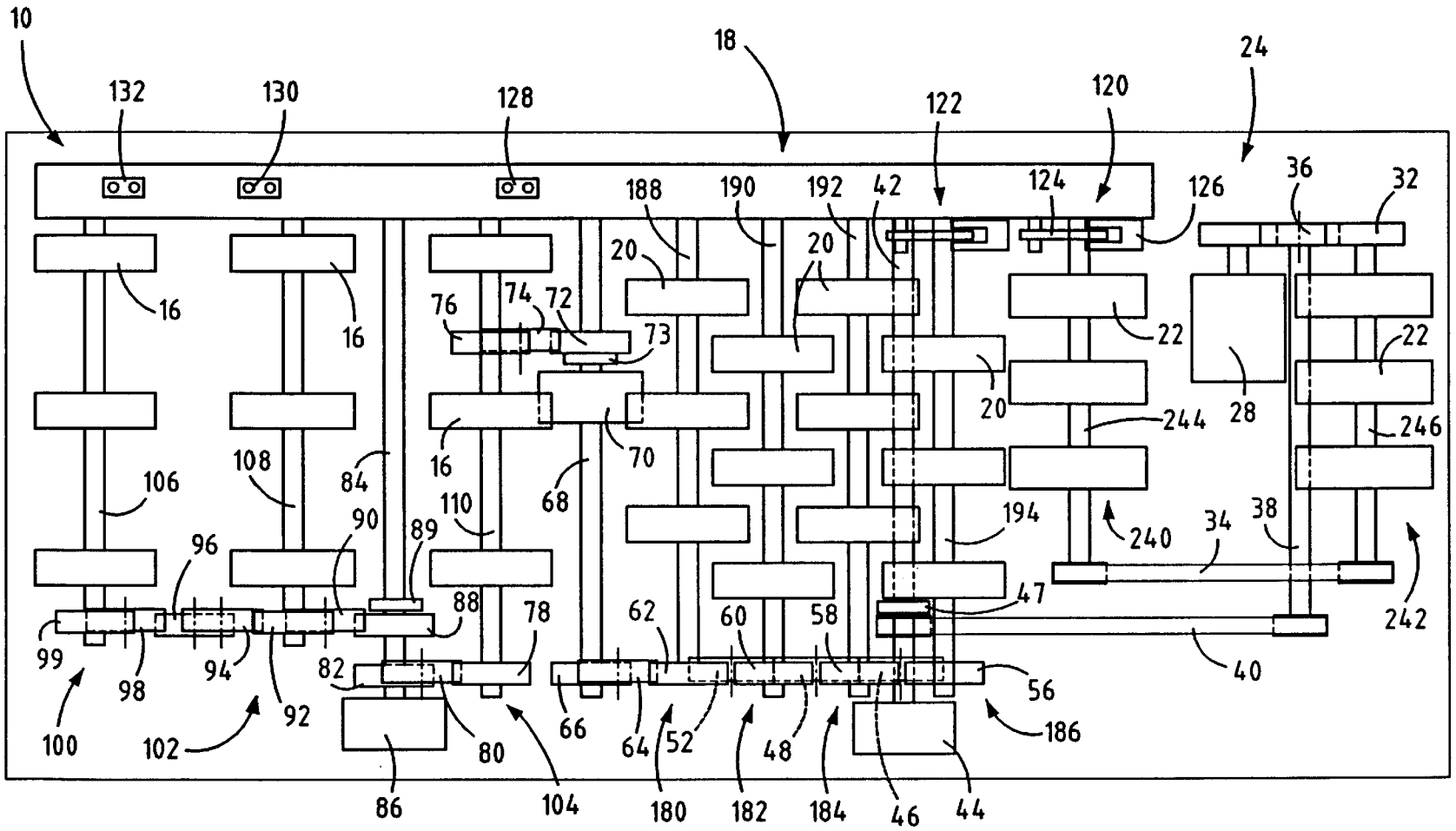
FIG. 2 is a plan view of the internal structure of the device from FIG. 1.
Figure 3:
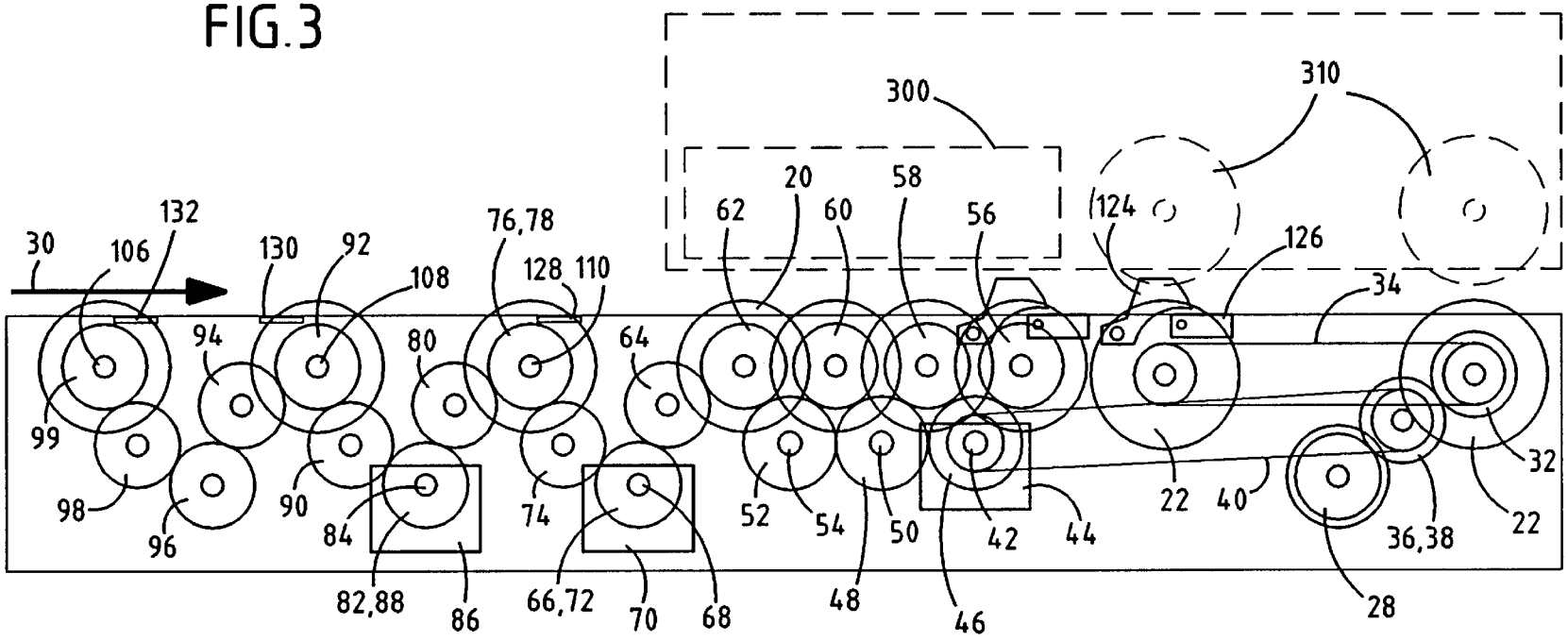
FIG. 3 is a profile view of the structure from FIG. 2.

FIGS. 2 and 3 show in more detail the internal structure of the feed device of the invention. The latter includes, in succession, in the direction in which a mail item is advanced along the transport path 30, three sets 100, 102, 104 of three transport rollers 16 mounted on three parallel rotation shafts 106, 108, 110 substantially perpendicular to the transport path 30 in the feed area 10, four sets 180, 182, 184, 186 of three transport rollers 20 also mounted on four parallel rotation shafts 188, 190, 192, 194 perpendicular to the transport path 30 in the selector area 18, and two sets 240, 242 of three rear and front transport rollers 22 mounted on two parallel shafts 244, 246 in the conveyor area 24. The sets of transport rollers of the separator area and the conveyor area are adapted to co-operate with a selector module 300 (FIG. 3) and conveyor rollers 310 (FIG. 3) respectively to select and to transport the selected mail item, possibly as far as the closing module, or to the entry of the franking machine if the feed device does not have any such closing module.

The various transport rollers are driven from the main motor 28 via various drive means formed of cogs, belts and clutches. For example, the output shaft of the motor 28 is connected by a first cog 22 to the shaft 246 on which the front conveyor rollers 22; 242 are mounted and this shaft is itself coupled to the shaft 244 on which the rear conveyor rollers 22; 240 are mounted by a first belt 34. A second cog 36 also connected to the output shaft of the motor 28 drives a first transmission shaft 38 which via a second belt 40 drives a second transmission shaft 42 on which are mounted a first clutch 44 and a third cog 36. This cog 46 meshes with a fourth cog 48 mounted on a third transmission shaft 50 and which itself meshes with a fifth cog 52 mounted on a fourth transmission shaft 54. These various cogs are adapted to co-operate with four corresponding cogs 56, 58, 60, 62 with rotation shafts 188, 190, 192, 194 on which are mounted the transport rollers 20 of the selector area 18. Note however that all the rollers of the selector area (which are then driven with the rollers of the conveyor area) can be driven only if the first clutch 44 (E1) is activated. The cog 62 mounted on the rotation shaft 188 nearest the feed area 10 meshes with a first intermediate cog 64 which in turn meshes with a sixth cog 66 mounted on a fifth transmission shaft 68 which also carries a second clutch 70 (E2). A seventh cog 72 also mounted on the fifth shaft 68 meshes through a second intermediate cog 74 with a cog 76 fastened to the shaft 110 on which are mounted the feed rollers 16; 104 nearest the selector area 18. This shaft carries another cog 78 which, via a third intermediate cog 80, drives an eighth cog 82 mounted on a sixth transmission shaft 84 which also carries a third clutch 86 (E3). The sixth transmission shaft also carries a ninth cog 88 which meshes via a fourth intermediate cog 90 with a cog 92 fastened to the shaft 108 on which is mounted the second set (or central set) of feed rollers 16; 102. This cog 92 drives a cog 99 driving the shaft 106 on which are mounted the feed rollers 16; 100 at the entry of the feed area 10 via three other intermediate cogs 94, 96, 98. Note that the second clutch E2, when activated, drives the rollers of the last set 104 (those at the exit from the feed area) at the same time as those of the selector and conveyor areas and that the third clutch E3 drives all the rollers of the feed area conjointly with those of the other areas of the device of the invention when it is activated in its turn.

The set 240 of transport rollers 22 of the conveyor area nearest the selector area 18 includes a first sensor 120 (C1) for sensing the presence of a mail item at the entry to the conveyor area 24. Similarly, one set of transport rollers 20 of the selector area 18, advantageously the set 186 nearest the exit from this area, includes a second sensor 122 (C2) for sensing the presence of a mail item in the selector area, preferably at the exit from that area. Each of these two sensors, which are advantageously of the opto-mechanical type, includes a flag or shutter 124, for example, which is actuated by the passing edge of the mail item and rotation of which interrupts the light path of a light-emitting diode (or between light-emitting diodes) contained in a housing 126 attached to the body of the feed device.

Three other sensors are disposed in the feed area 10 to sense the format of the mail items. A third sensor 128 (C3) is preferably placed at the exit from this feed area at the location of the third set 104 of transport rollers 16 to sense small format mail items (up to approximately 160 mm). Similarly, a fourth sensor 130 (C4) is placed substantially towards the middle part of this area at the location of the second set 102 of transport rollers 16 to sense medium format mail items (in the range about 160 mm to about 240 mm). Finally, large format items (more than approximately 240 mm) are sensed by a fifth sensor 132 (C5) preferably placed at the entry of the feed area at the location of the first set 100 of transport rollers 16. Of course, this number of sensors is in no way limiting on the invention: it is entirely feasible to use a greater or lesser number of sensors and in particular to provide as many sensors as there are mail item formats to be sensed.

Figure 4:
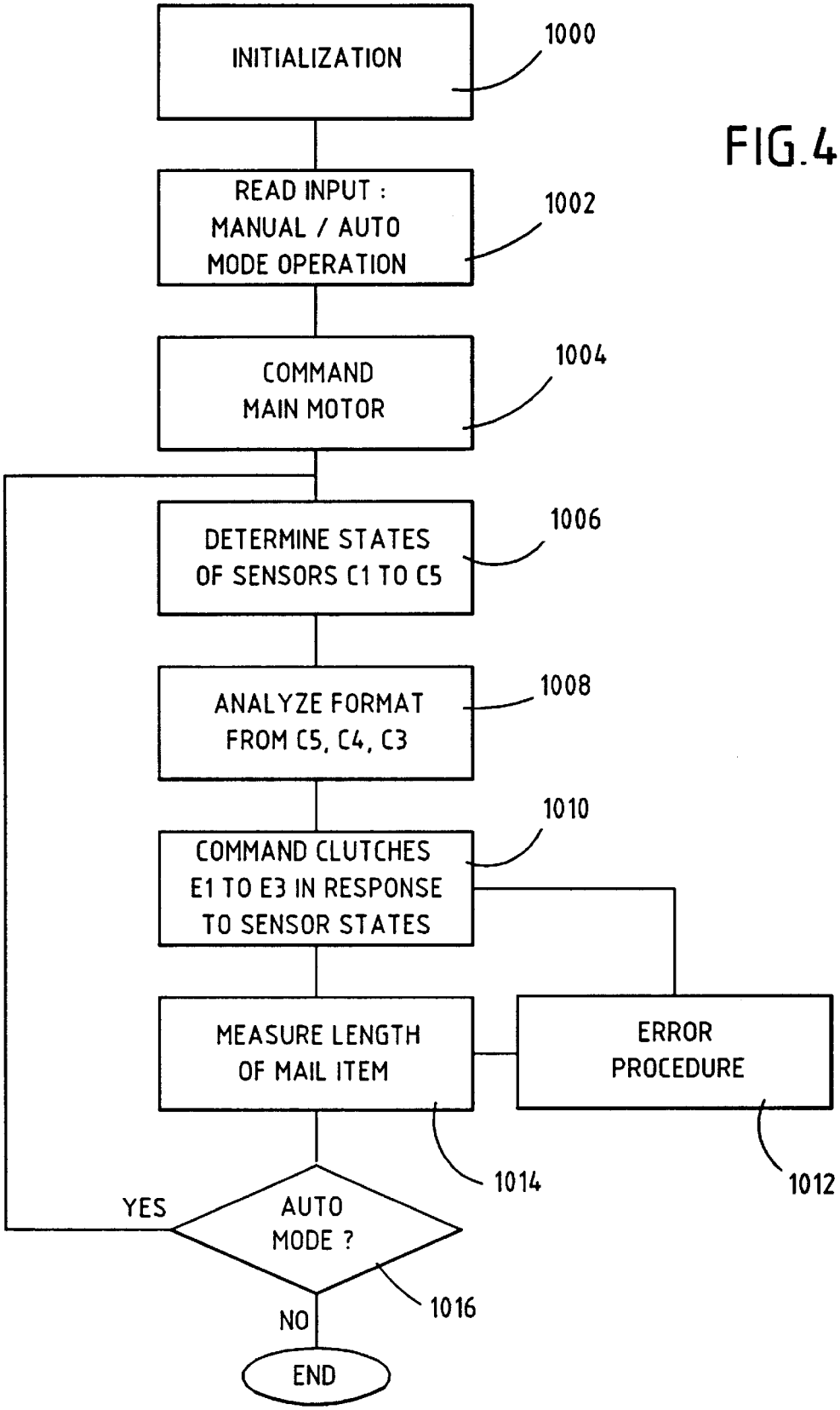
FIG. 4 is a flowchart explaining the operation of the feed device of the invention.

The operation of the device of the invention is described with reference to FIG. 4 which is a flowchart detailing the sequence of operation of the clutches in accordance with the states of the various sensors.

After an initial step 1000 of initializing various parameters necessary to the operation of the device, step 1002 entails reading a control input that can be actuated by an operator and corresponds to the required mode of operation for the processing of mail items (automatic or manual), after which the main motor 28 is started (step 1004). The states of the sensors C1 through C5 are then determined (step 1006) and the format of the mail item is obtained in the next step (1008) on the basis of the states of the three sensors C5, C4, C3 in the feed area. If the sensors C5, C4, C3 are active, this indicates the presence of large format mail items in the device. On the other hand, if C5 is inactive and C4 and C3 are active, medium format items are present. The presence of small format items is indicated by C3 alone being active and the absence of any item in the device by all three sensors C5, C4, C3 being inactive. At the end of this format analysis step, the set of clutches E1, E2, E3 is commanded (step 1010) to cause the mail items to be advanced towards the selector area 18 and then, depending on the states of the last two sensors C2 and C1, their successive disabling. Thus, if only C3 remains active when C2 becomes active (i.e. in the presence of a small format item) the clutches E2 and E3 are stopped. On the other hand, if C3 and also C4 are still active (medium format) only the clutch E3 is disabled. Finally, if all three sensors of the feed area are still active when the mail item reaches the sensor C2 of the selector area, indicating the presence of a large format item, no action is taken at the clutches, which continue to transmit drive. Similarly, when this mail item reaches the last sensor C1 of the conveyor area the clutches still operating are stopped (note that if C1 does not become active after a predetermined time, which could indicate a jam at the selector module or sensing of the presence of multiple documents, for example, an error procedure is initiated in step 1012).

Unless only the sensor C5 is still active, in which case the clutch E3 is first disabled and then the clutches E2 and E1 are also disabled after a predetermined time-delay (for example a time-delay of 70 ms for envelopes more than 240 mm long), the length of the mail item is then measured (step 1014) to enable close control of the spaces between items. This measurement is effected in a manner known in itself by a pulse encoder on the motor 28. Finally, according to the operating mode entered in step 1002, the motor is stopped in step 1016 (manual feed mode) or the system loops on determining the states of the sensors (step 1006).

The structure of the invention assures optimum control of the clutches and consequently minimizes the use of the main motor of the device to which these clutches are coupled. This significantly improves the reliability of the feed device of the invention.

Freewheels 89, 73, 47 can be disposed on the transmission shafts 84, 68, 44 to allow easy evacuation of the mail item in the downstream direction despite the sequenced stopping of the clutches E3, E2, E1.

Optimum control of the clutches assures convenient control of and optimizes the distance between two consecutive envelopes. The electronics can also be programmed flexibly to adapt the feeder to a specific machine base, in particular in terms of throughput.

We claim:

1. A device for feeding mail items adapted to be mounted on the upstream side of a franking machine and including in succession along a transport path of said mail items a first or mail item feed area for receiving a stack of mail items of various formats and including a first plurality of transport rollers, a second or selector area for individually selecting said mail items and including a second plurality of transport rollers, and a third or conveyor area for conveying the items extracted individually from the stack of mail items one by one and directing them to the franking machine and including a third plurality of transport rollers, the device including a first plurality of sensors for identifying the various formats of the mail items present in said first area, a second plurality of sensors for detecting passage of the mail items through said second and said third areas, and a plurality of drive mechanisms adapted to cooperate with said pluralities of transport rollers and actuated selectively in a predetermined sequence defined by a controller according to the state of each of said first and said second pluralities of sensors;

wherein said plurality of drive mechanisms includes a first clutch in said selector area and driving transportation rollers of said selector area and second and third clutches in said feed area and driving transportation rollers of said feed area.

2. A feed device according to claim 1, wherein each of the sensors of said first plurality of sensors determines a predetermined mail item format.

3. A feed device according to claim 2, wherein said first plurality of sensors includes a first format sensor at the entry of said feed area for determining large format mail items, a second format sensor at the exit of said feed area for determining small format mail items, and a third format sensor in a middle area of said feed area for determining medium format mail items.

4. A feed device according to claim 2, wherein each of the sensors of said first plurality of sensors for determining mail formats is a reflective type sensor.

5. A feed device according to claim 1, wherein each of the sensors of said second plurality of sensors determines the passage of a mail item at a predetermined location.

6. A feed device according to claim 5, wherein said second plurality of sensors includes a first or selector sensor at the exit of said selector area and a second or conveyor sensor disposed further downstream in said conveyor area.

7. A feed device according to claim 5, wherein each of the sensors of said second plurality of sensors is an opto-mechanical type sensor actuated by the passage of the edge of a mail item.

8. A feed device according to claim 1, wherein said second and said third clutches respectively and independently drive separate first and second sets of transport rollers of the said feed area.

9. A feed device according to claim 1, wherein said clutches are driven via a set of cogs and belts from a single drive motor which also drives said transport rollers of said conveyor area.

* * * * *